US005710968A

United States Patent [19]

Clark et al.

[11] Patent Number: 5,710,968

[45] Date of Patent: Jan. 20, 1998

[54] BYPASS TRANSPORT LOOP SHEET INSERTION SYSTEM

[75] Inventors: Lawrence A. Clark, Webster; Terrence R. Docteur, Canandaigua; Richard E. Eisemann, Rochester, all of N.Y.; Ted A. Beer, Oklahoma City, Okla.

[73] Assignee: Xerox Corporation, Stamford, Conn.

[21] Appl. No.: 520,354

[22] Filed: Aug. 28, 1995

[51] Int. Cl.[6] ..... G03G 21/00

[52] U.S. Cl. ..... 399/382; 271/3.19

[58] Field of Search ..... 399/381, 382, 399/18, 19, 20; 271/3.19, 300, 301, 302, 303

[56] References Cited

U.S. PATENT DOCUMENTS

| | | | |
|---|---|---|---|
| 4,248,525 | 2/1981 | Sterrett | 355/14 SH |
| 4,536,078 | 8/1985 | Ziehm | 355/14 SH |
| 4,602,776 | 7/1986 | York et al. | 271/4 |
| 4,961,092 | 10/1990 | Rabb et al. | 355/323 |
| 5,272,511 | 12/1993 | Conrad et al. | 355/325 |
| 5,457,524 | 10/1995 | Metcalf et al. | 399/382 |
| 5,489,969 | 2/1996 | Soler et al. | 399/18 |
| 5,559,595 | 9/1996 | Farrell | 399/382 |

OTHER PUBLICATIONS

Xerox Disclosure Journal; John R. Yonovich; "Dual Function Sheet Feeder"; vol. 19, No. 4 Jul./Aug. 1994 pp. 333–336.

*Primary Examiner*—R. L. Moses

*Attorney, Agent, or Firm*—Denis A. Robitaille

[57] ABSTRACT

A dual path sheet feeder is disclosed including a bypass transport loop and a main transport loop for selectively delivering sheets from a sheet feeding module to either a printer processing module or to a finishing module, wherein a movable gate situated adjacent to the bypass transport loop is provided for directing sheets along a predetermined path of travel. The movable gate is selectively positionable between a first position for directing the sheets through the main transport loop to the processing module to produce copy sheets prior to delivering the copy sheets to the finishing module and a second position for directing the sheets through the bypass transport loop to deliver insert sheets directly to the finishing module, circumventing the processing module. The dual path sheet feeder is contemplated for use in conjunction with a high speed electrostatographic printing machine for providing flexible paper supply options without the additional burden of providing supplemental dedicated sheet feeding trays.

15 Claims, 2 Drawing Sheets

BYPASS TRANSPORT LOOP SHEET INSERTION SYSTEM

Figure 1:
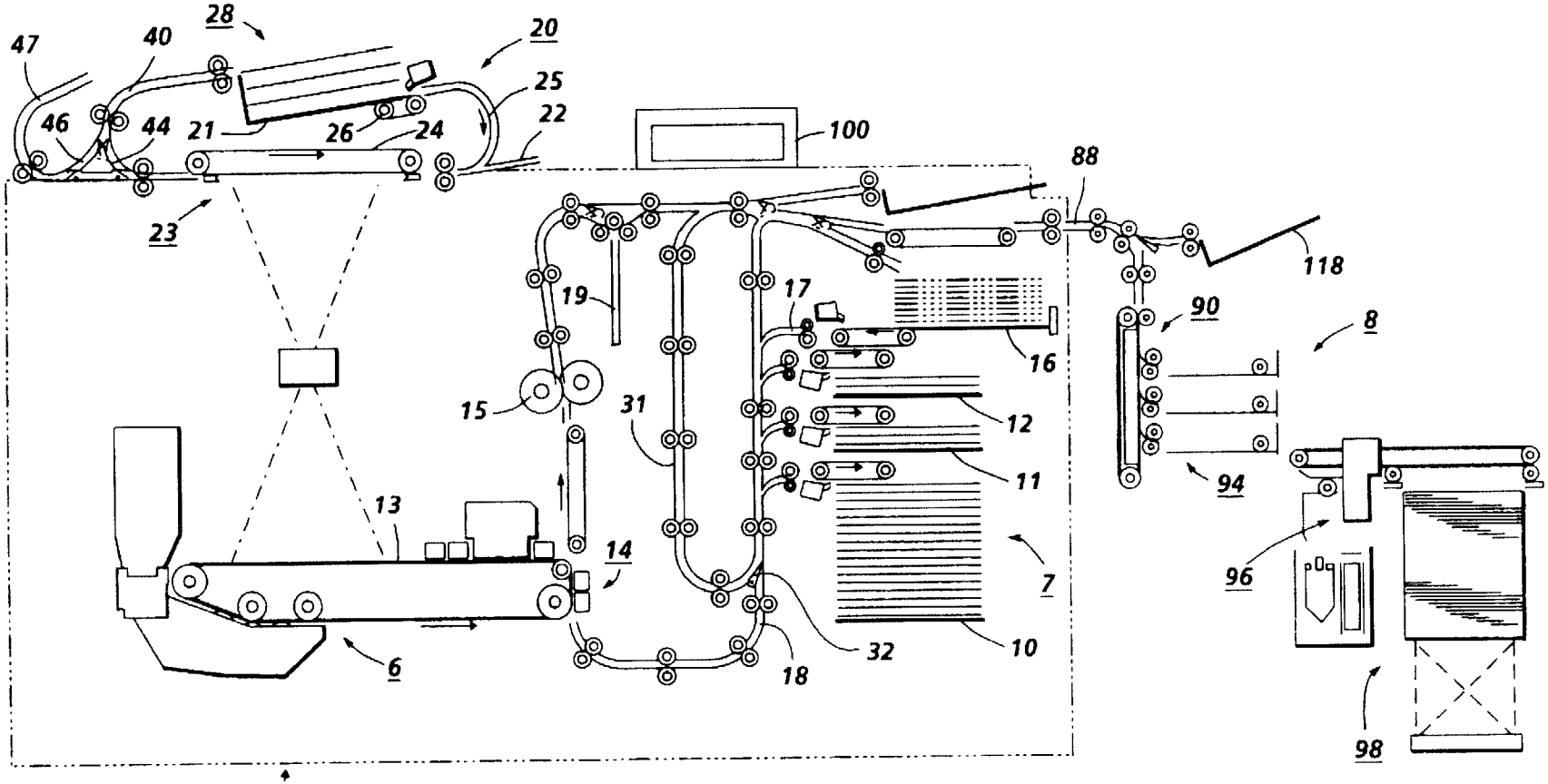

This invention relates generally to a sheet insertion system for use in an electrostatographic printing machine to produce a print job including one or more imaged substrates and at least one insert sheet, and, more particularly, to a sheet insertion system having a bypass transport loop fro delivering the insert sheet into a stream of imaged substrates to produce a print set.

Generally, the process of electrostatographic reproduction is executed by exposing a light image of an original document to a substantially uniformly charged photoreceptive member. Exposing the charged photoreceptive member to a light image operates to discharge the photoconductive surface thereof in areas corresponding to non-image areas in the original document, while maintaining the charge on the image areas, for creating an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred in image configuration, from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The primary output product for a typical electrostatographic printing system is a printed copy substrate, such as a sheet of paper bearing printed information in a specified format. Quite often, customer requirements necessitate that this output product be configured in various specialized arrangements or print sets ranging from stacks of collated loose printed sheets to tabulated and bound booklets. Even when using state-of-the-art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to product a final document. As a specific example, it is common to use preprinted sheets, which may have been produced by four-color offset press, as special insert sheets in a document containing mostly text printed on ordinary white paper to create a final output document. In another example, booklets produced from signatures often use special cover sheets or center sheets containing, for example, coupons. It is generally not desirable to pass these special insert sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

Accordingly, it is desirable to have special insert sheets inserted into a stream of sheets subsequent to processing in the printer processor section of the document producing apparatus. More importantly, these sheets must be inserted without disrupting the flow of the continuous stream of processed sheets. It is also desirable to insert these sheets in a manner which is transparent to the print processor or the finishing apparatus so that the operation of these apparatus need not be modified. The following disclosures appear to be relevant:

U.S. patent application Ser. No. 08/316,952
Inventor: Metcalf et al.
Filed: Oct. 13, 1994

U.S. Pat. No. 5,272,511
Patentees: Conrad et al.
Issued: Dec. 21, 1993

U.S. Pat. No. 4,961,092
Patentee: Rabb et al.
Issued: Oct. 2, 1990

U.S. Pat. No. 4,602,776
Patentee: York et al.
Issued: Jul. 29, 1986

U.S. Pat. No. 4,536,078
Patentee: Ziehm
Issued: Aug. 20, 1985

U.S. Pat. No. 4,248,525
Patentee: Sterret
Issued: Feb. 3, 1981

Xerox Disclosure Journal—Vol. 19, No. 4, pp. 333–336
Patentee: John R. Yonovich
Disclosed: July/August 1994

The relevant portions of the foregoing disclosures may be briefly summarized as follows:

U.S. patent application Ser. No. 08/316,952 discloses a dual path sheet feeder including a dual mode sheet feeding tray for selectively delivering sheets from a sheet feeding module to either a printer processing module or to a finishing module, wherein a movable gate situated adjacent to the sheet feeding tray is provided for directing sheets along a predetermined path of travel. The movable gate is selectively positionable between a first position for directing the sheets to the processing module to produce copy sheets prior to delivering the copy sheets to the finishing module and a second position for directing the sheets directly to the finishing module by transporting the sheets in a reverse direction to bypass the processing module to provide an insert sheet. The dual path sheet feeder is contemplated for use in conjunction with a high speed electrostatographic printing machine for providing flexible paper supply options without the additional burden of providing supplemental dedicated sheet feeding trays.

U.S. Pat. No. 5,272,511 discloses a sheet inserter for inserting one or more special insert sheets into a continuous stream of sheets by overlaying the insert sheets with a corresponding sheet in the continuous stream of sheets. The insert sheet overlaying the corresponding sheet in the continuous stream of sheets is then conveyed with the corresponding sheet to a final destination where the sheets can be compiled into a stack.

U.S. Pat. No. 4,961,092 to Rabb et al., assigned to Xerox Corporation, discloses a preprogrammed post-collation system for a copier which uses plural sorter bins and a recirculating document handler. Preprogrammable pause points in the copying operation allow for repeatedly inserting a variable number of job inserts or other special copy sheets into the bins being filled (by producing copies of these special documents or by manually inserting them into the bins), at any selected document copying point. The copying sequence must be manually restarted after the appropriate insertion operation is completed.

U.S. Pat. No. 4,602,776 to York et al., assigned to Xerox Corporation, discloses an insertion apparatus for use with a copier and/or a collator for providing on-line and off-line insertion of sheet material or collation, respectively. A supply tray is loaded with one or more types of insert material, each type being separated by a first type of coded sheet. A copying operation is interrupted when a second type of coded sheet, located in the stack to be copied and indicating a location where insert sheets are to be inserted, is detected. As the insert sheets are fed, a second sensor detects the first type of coded sheet (indicating the end of the group of insert sheets), which is then fed to an overflow tray. The normal copying operation is then resumed.

U.S. Pat. No. 4,536,078, assigned to Xerox Corporation, to Ziehm discloses an automatic document handling system for recirculative document duplex copying to provide precollated simplex or duplex copies with proper image orientation on the output copy sheet for copies made on special orientation restricted copy sheets as well as non-orientation sensitive copy sheets. A switching system is provided for selecting between feeding of copy sheets from a main supply tray or a special copy sheet supply tray. A control system is provided for causing the document handling system to circulate the input copy sheets once before copying, to count the input copy sheets and to determine whether an odd or even number of input sheets are being provided to improve operating efficiency.

U.S. Pat. No. 4,248,525 to Sterrett discloses an apparatus for producing sets of collated copies wherein some of the sheets in a document (regular sheets) can be reproduced in a collating mode by means of a copier having a recirculating document handler (RDH), while other sheets in the document (insert sheets) cannot be produced in a collating mode by the RDH. Each sheet which cannot be imaged using the RDH is first individually copied multiple times and fed to a separate storage bin. These sheets later will be inserted into the stream of collated regular sheets as they are copied and output from the copier. A controller is preprogrammed with the page numbers of the sheets to be inserted. The regular sized sheets are then placed (in order) in the RDH, and multiple collated copies are made and fed toward a finisher (stapler). Copies of the regular sized sheets in the document are thus output from the copier in order (collated), with the insert sheets missing. Since the controller keeps track of the number of sheets being copied, the controller is able to temporarily stop the RDH at the appropriate time and cause the appropriate insert sheet to be fed from its corresponding storage bin into the stream of regular sheets output from the copier. Thus, collated complete print sets of a particular document are generated.

Xerox Disclosure Journal Volume 19, No. 4, pp. 333–336 discloses a dual function sheet feeder including first and second sheet feeding paths which share common initial document path portion, diverting at a gate to provide separate functions. The first sheet feeding path allows input documents to be transported for document imaging and onward to a document restacking tray. The second sheet feeding path allows transport of input documents into a print engine input path to be merged into the regular sheet feeding path for delivery to the finisher.

As will be seen from an examination of the cited prior art, it is desirable to provide an electrostatographic copying system with various paper supply options for permitting the utilization of several different types of paper or copy substrates in the same print job. Primarily, customers desire the capability to insert copy sheets directly into a flow of sheets being transported to a finisher section, thereby bypassing the imaging section of the machine. However, the addition of paper trays for accomplishing such a task is limited by machine space and adds cost to the machine. As disclosed by the present invention, it is advantageous to provide a paper tray which permits selective feeding of copy sheets to either the image processor section of the machine or directly to the finisher section of the machine via a bypass paper transport loop.

In accordance with one aspect of the invention, a printing apparatus is provided, including a processing section for transferring a developed image onto a copy sheet and a finishing section for receiving plural copy sheets and at least one insert sheet to generate a print set, comprising: a sheet feeding tray for storing sheets to be utilized in producing the print set; a sheet feeding apparatus associated with the sheet feeding tray for dispensing sheets therefrom; a main supply transport path coupled between the sheet feeding tray and the processing section for delivering copy sheets thereto; a bypass transport loop coupled between the main supply transport loop and the finishing section for delivering insert sheets thereto; and a movable gate situated adjacent the bypass transport loop for selectively directing sheets along a predetermined path of travel, the movable gate being selectively positionable between a first position for directing the sheets through the main supply transport path and a second position for directing the sheets to the bypass transport loop.

In accordance with another aspect of the present invention, a dual path paper feeder system for selectively delivering sheets to a predetermined output location is provided. The dual path paper feeder system comprises: at least one sheet feeding tray; a sheet feeding apparatus associated with each the at least one sheet feeding trays for dispensing sheets therefrom; a main supply transport path coupled to the at least one sheet feeding trays for transporting sheets along a primary path; a bypass transport loop coupled to the at least one sheet feeding trays for transporting sheets along a bypass transport path; and a movable gate situated adjacent the bypass transport loop for selectively directing sheets along a predetermined path of travel, the movable gate being selectively positionable between a first position for directing the sheets through the main supply transport path and a second position for directing the sheets through the bypass transport loop.

In accordance with another aspect of the present invention, in a printing apparatus including a processing section for transferring a developed image to a copy sheet and a finishing section for receiving a stream of copy sheets, an an improvement is provided, comprising a dual path sheet feeder system, including a sheet feeding tray for selectively dispensing copy sheets to the processing section and insert sheets to the finishing section; a main supply transport path coupled between the sheet feeding tray and the processing section for delivering copy sheets thereto; a bypass transport loop coupled between the sheet feeding tray and the finishing section for delivering insert sheets thereto; and a movable gate situated adjacent the bypass transport loop for selectively directing sheets along a predetermined path of travel, the movable gate being selectively positionable between a first position for directing copy sheets through the main supply transport path and a second position for directing insert sheets to the bypass transport loop.

In accordance with yet another aspect of the present invention, a printing apparatus is provided for producing a print set including a plurality of copy sheets and at least one insert sheet inserted therein in a predetermined sequence. The printing apparatus comprises processing section for transferring a developed image onto a copy sheet; a finishing section for receiving and arranging plural sheets in a predetermined manner; at least one sheet feeding tray for selectively delivering copy sheets and insert sheets stored therein into a sheet transport system, the sheet transport system including a main supply transport path coupled between the sheet feeding tray and the processing section for delivering copy sheets thereto; a bypass transport loop coupled between the main supply transport loop and the finishing section for delivering insert sheets thereto; and a movable gate situated adjacent the bypass transport loop for selectively directing sheets along a predetermined path of travel, the movable gate being selectively positionable between a first position for directing the sheets through the main supply transport path and a second position for directing the sheets to the bypass transport loop.

Figure 2:
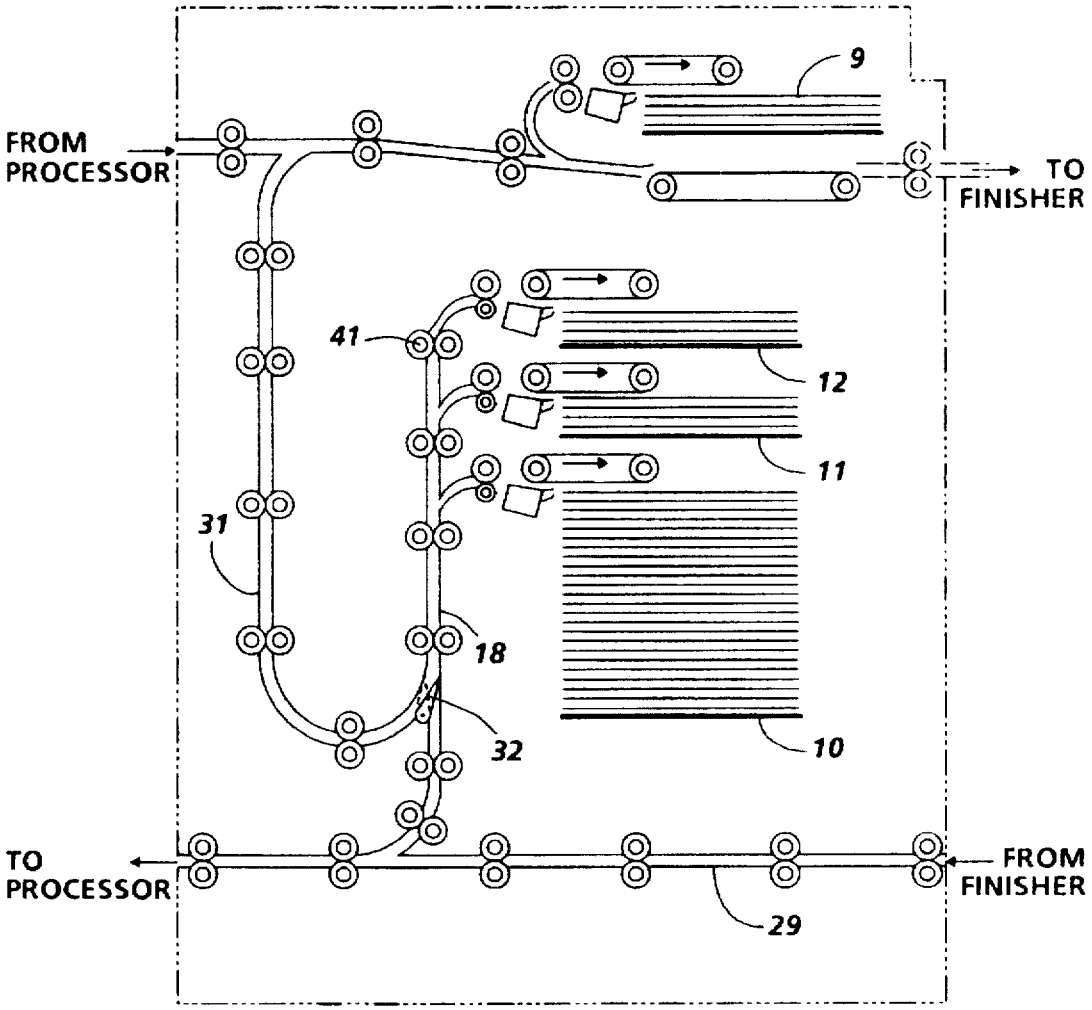

For a general understanding of the present invention, as well as other aspects thereof, reference is made to the following description and drawings, in which like reference numerals are used to refer to like elements, and wherein:

FIG. 1 is a schematic elevational view of an electrostatographic printing system, illustrating the principal mechanical components thereof including the bypass transport loop sheet insertion system of the present invention; and FIG. 2 is a schematic elevational view of a sheet feeder module incorporating a bypass transport loop sheet insertion system in accordance with the present invention.

While the present invention will hereinafter be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 1 incorporates a recirculating document handler (RDH) 20 of a generally known type, which may be found, for example, in the well known Xerox Corporation model "1075" or "5090" duplicators, among others. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler as generally identified by reference numeral 20. As is conventionally practiced, the entire document handler unit 20 may be pivotally mounted to the copier so as to be capable of being lifted by an operator for alternative manual document placement and copying. In this manner, the exemplary printing system 2 is designed to receive input documents as manually positioned on an optically transparent platen or as automatically positioned thereon via a document handler, such as a recirculating document handler (RDH) 20, via a document handler input tray 21 or a document feeder 22.

The RDH 20 operates to automatically transport individual registered and spaced document sheets into an imaging station 23, operatively associated with the xerographic processing section 6. A platen transport system 24 is also provided, which may be incrementally driven via a non-slip or vacuum belt system controlled by a system controller 100 for stopping the document at a desired position for copying in a manner taught by various references known in the art.

The RDH 20 has a conventional "racetrack" document loop path configuration, which preferably includes generally known inverting and non-inverting recirculation paths for transporting original input documents back to a loading and restacking tray 21. For example, a set of duplex original document sheets may be stacked in this document tray 21 for reproduction thereof, as shown in FIG. 1. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22. Documents may be fed to the imaging station 23 and transported by the platen transport belt 24 from either the SADH input 22 at one side of the RDH 20, or from the regular RDH input, namely the loading or stacking tray 21, situated on top of the RDH unit. While the side loading slot 22 is referred to herein as the SADH feeding input 22, this input feeder is not limited to semi-automatic or "stream feed" document input feeding, but is also known to be usable for special "job interrupt"-type insert jobs. Normal RDH document feeding input comes from the bottom of the stack in tray 21, through arcuate, inverting RDH input path 25, to the upstream end of the platen transport 24. Input path 25 preferably includes a known "stack bottom" corrugated feeder-separator belt 26 and an air knife 27 system including document position sensors (not shown), and a set of turn baffles and feed rollers for inverting the incoming original documents prior to imaging.

Document inverting or non-inverting by the RDH 20 is further described, for example, in U.S. Pat. Nos. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray (not shown), or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion; or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21 for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 24). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed by an operator into a controller 100, as will be described.

Since the xerographic or electrostatographic copy or print operation and apparatus is well known and taught in numerous patents and other published art, that system will not be described in detail herein. Briefly, blank or preprinted copy sheets are conventionally provided by sheet feeder section 7, whereby sheets are typically delivered from a high capacity feeder tray 10, through a main supply transport 18 for processing to receive a copier document image from photoreceptor 13 at transfer station 14 via known electrostatographic processes. Alternatively, or in addition, copy sheets can be stored and delivered to the xerographic processing section 6 through the main supply transport 18 via auxiliary paper trays 11 or 12 which may be provided in an independent or a stand alone device coupled to the electrophotographic printing system 2, as shown in FIG. 2.

After a developed image is transferred to a copy sheet, an output copy sheet is delivered to a fuser 15 to form a permanently affixed image on an output copy sheet. The output copy sheets are subsequently transported to finishing section 8 via output path 88 if the output copies are to be simplex copies, or temporarily delivered to an inverter 19 for creating a duplex output copy sheet or stacked in a duplex buffer tray 16 if multiple output copies are to be duplexed. In the latter case, the single side copies are inverted and returned to printing system 2 via path 17 for receiving a second side developed image in the same manner as the first side. The duplex buffer tray 16 has a finite predetermined sheet capacity, depending on the particular copier design. The completed duplex copy is inverted in inverter 19 and transported to finishing section 8 via output path 88 in the same manner as a simplex copy sheet.

Output path 88 may be directly connected in a conventional manner to a bin sorter 90 as is generally known and as is disclosed in commonly assigned U.S. Pat. No. 3,467,371, incorporated in its entirety by reference herein. Bin sorter 90 may include a vertical bin array 94 which is conventionally gated (not shown) to deflect a selected sheet into a selected bin as the sheet is transported past the bin entrance. An optional gated overflow top stacking or purge tray may also be provided for each bin set. The vertical bin array 94 may also be bypassed by actuation of a gate for directing sheets serially onward to a subsequent finishing station. The resulting sets of prints are then discharged to finisher 96 which may include a stitcher mechanism for stapling print sets together and/or a thermal binder system for adhesively binding the print sets into books. A stacker 98 may also by provided for receiving and delivering final print sets to an operator or to an external third party device.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the bypass loop sheet insertion system of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the bypass loop of the present invention, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Turning now to the specific example of the present invention disclosed herein, and, in particular, as illustrated in FIGS. 1 and 2, a bypass transport loop sheet insertion system is provided, wherein output sheets stored in a single or in multiple sheet feeding trays may be selectively transported along dual paths, either the main paper supply transport 18 or the bypass loop transport of the present invention for selectively directing output sheets either to the xerographic processing section 6 or directly to the finishing section 8. As previously described, copy sheets or other substrates used for producing a print set or final output document are generally supplied from either a main sheet feeding or supply tray 10 or one of various auxiliary sheet feeding supply trays, such as exemplary supply trays 11 or 12. Each supply tray is operative in conjunction with a sheet feeding mechanism such as a commonly known scuff feeder or a belt and drag system, as illustrated schematically herein, designed and positioned for engaging sheets from the top of a stack in a respective sheet feeding supply tray to dispense the topmost sheet into the main paper supply transport 18. The sheet feeding apparatus may also include a series of sheet position sensors (not shown) and/or an air knife system, as shown in schematic form, for effectively separating a singular sheet from a stack of sheets for being dispensed from the sheet feeding tray. Further details of exemplary sheet feeding apparatus which may be used in conjunction with feeder trays 10, 11 and 12 for transporting copy sheets and the like are described in various other patents and publications, as for example, U.S. Pat. No. 4,054,380, incorporated by reference herein.

After being dispensed from a supply tray, sheets can be advanced along the path of main sheet transport 18 via a roller or belt transport, a vacuum transport system, or any other sheet transport system, as is generally known in the art. It will be understood that the various sheet feeders, roller transport members and other transport elements are coupled to the system controller, generally identified by reference numeral 100 for allowing information from various sensors and command signals to be exchanged between the sheet feeding section 8 and the other machine systems for effecting the desired sequence of operations. As such, the controller 100 synchronizes the various functions of the sheet feeding section so that the sheets are sequentially transported out of each sheet feeder and along the various paths of travel at the appropriate time.

Auxiliary sheet feeding supply trays 11 or 12 are adapted to support a quantity of sheets which may include copy sheets for having an image printed thereon via the xerographic section 6 or may include preprinted or special insertion sheets for being delivered either to the xerographic section 6 for additional printing or directly to the finishing section 8 for insertion into an output print set. For example, insertion sheets may include copy set cover sheets, separator sheets for "chapterizing" sections of each print set, sheets having file tabs, or sheets of various colors, among other sheet types. These insertion sheets are typically transported directly to the finishing section 8 for being inserted into a print set during a reproduction job and, therefore, do not require transport through the xerographic section 6. Indeed, in many instances, insertion sheets may contain preprinted material or may be provided in such an arrangement which might induce a paper transport jam in the xerographic processing section 6 if transported thereto and, therefore, may not be suited for transport through the xerographic processing section 6.

In order to provide a dual path paper feeder system which facilitates the transport of sheets to either the processing section 6 or directly to the finishing section 8, the present invention of FIGS. 1 and 2 provides a bypass transport loop 31 for directing sheets directly to the finisher section 8, thereby allowing the transport of sheets through the xerographic processor section 6 to be circumvented in order to allow direct transport into the finishing section 8. The present invention also includes a movable decision gate 32 in operative association with the bypass transport loop 31. The movable decision gate 32 is situated adjacent the entrance to the bypass loop 31, at the junction with the main sheet transport 18 for directing sheets along a predetermined path of travel defined by either the main sheet transport 18 or the bypass transport loop 31. The decision gate 32 includes pivotable fingers which may be rotated in response to a command signal from controller 100 for deflecting a copy sheet dispensed from a sheet feeder tray, there by causing the input sheet to be deflected and transported along the desired transport path, either in the main sheet transport 18 toward the xerographic processor 6, or in the bypass loop 31 toward the finisher 8. Thus, as can be seen from the drawings, the movable gate 32 can be positioned in two positions: a first position for blocking the entrance to the bypass transport loop to direct sheets downward through the main sheet transport 18, whereby sheets are transported to the processing section 6 for having a developed image transferred thereto prior to delivery to the finishing section 8; and a second position for deflecting sheets into the bypass transport loop, whereby sheets are transported directly to the finishing section 8 so as to avoid the processing section 6.

The operation of the dual path paper feeder system, as described hereinabove, will now be described. It will be assumed that an output copy job or so-called print set will comprise a plurality of copy sheets having developed images transferred thereto via processing section 6, corresponding to input document sheets having a successive page sequence order. In addition, the print set will further comprise at least one insert sheet, which may include a preprinted sheet, a tab stock sheet, a colored sheet, etc. which is to be inserted into the print set at a predetermined location, wherein the insert sheet does not require that a developed image be transferred thereto via processing section 6. Indeed, it may be preferable that the insert sheet can not be transported through the processing section 6. In accordance with this assumed print job configuration, blank or clean copy sheets are stored in main sheet feeding tray 10, while presorted insert sheets are stored in auxiliary sheet feeding trays 11. It will be understood that other types of insert sheets may be included in the print job and may be stored in auxiliary sheet feeding tray 12 for transport in the same manner as described herein. Alternatively, auxiliary sheet feeding tray 11 and/or 12 may be provided with additional blank copy sheets to provide increased copy sheet capacity or may be provided with other copy sheets which will be transported though processing section 6 for having a developed image transferred thereto, thereby providing additional copy sheet flexibility.

Prior to the production of a print set, the controller is provided with instructions regarding the precise sequence at which insert sheets are to be introduced into the flow of copy sheets output from processing section 6. In a preferred embodiment, controller 100 provides control signals to each of the sheet feeding trays, as well as the various subsystems of the xerographic processing section 6 and other machine subsystems so that throughput to the finishing section 8 is maintained at a maximum level. To this end, timing of the sheet feeding mechanisms associated with each sheet feeding tray as well as the position of each of the directional gates disposed along the path of travel of the sheet is precisely coordinated so that insert sheets from auxiliary supply trays 11 or 12 will be inserted into the flow of sheets exiting the processor section 6 immediately after a designated copy sheet, such that no machine pitch or copy cycle is lost during the inserting process. Likewise, the timing of copy sheet processing is precisely scheduled to assure that a copy sheet is processed and transported in the direction of the finisher in close sequence with the insertion of a designated insert sheet. In addition, the control arrangement is adapted to permit the apparatus to integrate insert sheets into the flow of processed copy sheets exiting the processor section 6 in conjunction with the use of the automatic recirculating document handler 20 as well as the finishing section 8.

During the production of a print set, when it is desired to effect seriatim feeding of insert sheets into the print set, controller 100 provides a control signal which causes deflector gate 32 to be in position for deflecting sheets dispensed from auxiliary sheet feeding tray 11 (or any other tray) through the bypass loop 31 for transport directly to the finishing section 8. Insert sheets are thus transported one after another in a timed sequence for insertion at a predetermined location into the flow of sheets exiting the processor section. Multiple different insert sheets may be stored in a predetermined order for appropriate delivery of various inserts into a final print set. Alternatively, when the production of a print set does not require insert sheets, the deflector gate 32 may be programmed to be in the position for allowing sheets to be transported through the main paper supply transport 18 to travel to the processor section 6, as in normal xerographic processing.

It will be understood that a particular advantage of the present invention is that a single sheet feeding tray can be utilized for supplying either copy sheets or insert sheets, thereby efficiently utilizing precious machine real estate by preventing the need for dedicated trays to serve each desired purpose. In the exemplary system shown and described herein, the customer is provided with three sheet feeding trays which can perform the function of multiple dedicated sheet feeding trays. It is further noted that in another alternative utilization scenario, it is contemplated that the bypass loop 18 of the present invention can be selectively actuated via deflector gate 32 at various selected times during the production of a print set such that both insert sheets and copy sheets can be stored in a single sheet feeding tray during the production of a print set. In this mode, it would be required that a precise count and sequence of individual copy sheets and insert sheets stored in a given sheet feeding tray be provided to the controller to provide proper timing of the actuation of gate 32.

It will be understood that the bypass transport loop of the present invention may be provided in the form of an add-on or in-line sheet feeding module, as shown in particular in FIG. 2, of the type which could be interposed between an independent printing processor module and a finishing module. Add-on or in-line sheet feeding modules may be advantageous in providing various machine configurations depending on customer requirements. For example, the add-on module might provide additional an copy sheet storage facility or additional sheet insertion capabilities as represented by additional inserter tray 9. Alternatively, or in addition, the add-on module may be provided with a paper path leading from the finisher to the xerographic processor, generally identified by reference numeral 29, for advantageous placement of a paper supply tray within the compartment of the finisher to add yet increased copy sheet storage. Also, the add-on module may or may not include the duplex handling tray 16, it being understood that this duplex handling tray may be incorporated solely into the xerographic machine 2. In the configuration shown in FIG. 2, additional auxiliary sheet feeding trays 11 or 12 may be coupled to the main paper supply transport 18 for supplying copy sheets to the xerographic printing section 6 or for supplying insert sheets directly to the finishing section 8. Movable decision gate 32 is selectively positionable between first and second positions, where a first position is provided for directing sheets to the processing section 6 for having a developed image transferred thereon with subsequent delivery of the copy sheet to the finishing section 8, while a second position is provided for directing sheets directly to the finishing section 8, so as to bypass the processing section 6.

It is noted that the bypass loop 18 of the present invention provides an advantageous solution to the problem of sheet insertion by eliminating any requirement that the main sheet transport 18 be modified such that transport roll pairs situated between the auxiliary sheet feeding trays and the finishing section 8. For example, in the previously cited U.S. patent application Ser. No. 08,316,952, a reversible roll pair is required in order to facilitate the transport of insert sheets to finishing section 8, as well as the transport of copy sheets to processing section 6. Of course, the reversible functionality of this transport roll pair would be required to be coupled to controller 100 in a manner similar to each sheet feeding tray and associated movable decision gate for initiating a sequencing schedule which monitors the transport and delivery of sheets to optimize particular operations and to assure the insertion of copy sheets and insert sheets in accordance with operator requirements. Obviously, such a reversible roll system adds to the complexity of the system and necessarily impacts the reliability thereof.

In review, the present invention provides a bypass transport loop for selectively delivering sheets from multiple sheet feeding trays either to a printer processing module for having a developed image transferred thereto with subsequent delivery of the developed image copy sheet to a finishing module or directly to the finishing module for being inserted in the flow of sheets being delivered to the finishing module from the processing module. The present invention provides high speed electrostatographic printing machines with a flexible paper supply option such that customers are provided with the additional capability of utilizing a single sheet feeding tray for the selective functions of inserting different types of insert sheets, as for example, preprinted, different color, different weight, etc., into a print set, or for transporting some sheets to an electrostatographic printing processor for having an image transferred thereto.

It is, therefore, evident that there has been provided, in accordance with the present invention, an electrostatographic copying apparatus having a bypass transport loop that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A printing apparatus, including a processing section for transferring a developed image onto a copy sheet and a finishing section for receiving plural copy sheets and at least one insert sheet to generate a print set, comprising:

a sheet feeding tray for storing sheets to be utilized in producing the print set;

a sheet feeding apparatus associated with said sheet feeding tray for dispensing sheets therefrom;

a main supply transport path coupled between said sheet feeding tray and the processing section for delivering copy sheets thereto;

a bypass transport loop coupled between said main supply transport path and the finishing section for delivering insert sheets thereto;

a movable gate situated adjacent said bypass transport loop for selectively directing sheets along a predetermined path of travel, said movable gate being selectively positionable between a first position for directing the sheets through the main supply transport path and a second position for directing the sheets to the bypass transport loop; and means for providing a control signal to said movable gate such that sheets can be selectively dispensed from said sheet feeding tray to either said main supply transport path or said bypass transport loop at various selected times during generation of a print set.

2. The printing apparatus of claim 1, including a controller for selectively positioning said movable gate between said first and second positions.

3. The printing apparatus of claim 1, wherein processing section includes an electrostatographic printing system.

4. A dual path paper feeder system for selectively delivering sheets to a predetermined output location, comprising:

at least one sheet feeding tray;

a sheet feeding apparatus associated with each said at least one sheet feeding tray for dispensing sheets therefrom;

a main supply transport path coupled to said at least one sheet feeding tray for transporting sheets along a primary path;

a bypass transport loop coupled to said at least one sheet feeding tray for transporting sheets along a bypass transport path;

a movable gate situated adjacent said bypass transport loop for selectively directing sheets along a predetermined path of travel, said movable gate being selectively positionable between a first position for directing the sheets through the main supply transport path and a second position for directing the sheets through the bypass transport loop; and means for providing a control signal to said movable gate such that sheets can be selectively dispensed from said at least one sheet feeding tray to either said main supply transport path or said bypass transport loop at various selected times during generation of a print set.

5. The dual path paper feeder of claim 4, wherein said main supply transport path is further coupled to an electrostatographic printing system for transferring a developed image to the sheets prior to delivery to the predetermined output location.

6. The dual path paper feeder of claim 4, including a controller for selectively positioning said movable gate between said first and second positions.

7. The dual path paper feeder of claim 5, including a controller for selectively transporting the sheets directly to the predetermined output location in a predetermined sequence for bypassing the electrostatographic printing system to insert the sheets from said at least one sheet feeding tray among the sheets delivered from the electrostatographic printing system to the predetermined location so as to effect seriatim feeding of insert sheets into a print set.

8. In a printing apparatus including a processing section for transferring a developed image to a copy sheet and a finishing section for receiving a stream of copy sheets, the improvement comprising:

a dual path sheet feeder system, including a sheet feeding tray for selectively dispensing copy sheets to said processing section and insert sheets to said finishing section;

a main supply transport path coupled between said sheet feeding tray and he processing section for delivering copy sheets thereto;

a bypass transport loop coupled between said sheet feeding tray and the finishing section for delivering insert sheets thereto;

a movable gate situated adjacent said bypass transport loop for selectively directing sheets along a predetermined path of travel, said movable gate being selectively positionable between a first position for directing copy sheets through the main supply transport path and a second position for directing insert sheets to the bypass transport loop; and means for providing a control signal to said movable gate such that sheets can be selectively dispensed from said sheet feeding tray to either said main supply transport path or said bypass transport loop at various selected times during generation of a print set.

9. The printing apparatus of claim 8, wherein said processing section includes an electrostatographic printing system.

10. The printing apparatus of claim 8, including control means coupled to said dual path sheet feeder system and to said movable gating system for causing said sheet feeding tray to dispense a sheet either to said processing section or to said finishing section.

11. The printing apparatus of claim 8, wherein said insert sheets include preprinted sheets.

12. The printing apparatus of claim 8, wherein said insert sheets include sheets having a selected tab stock.

13. The printing apparatus of claim 8, wherein said insert sheets include sheets having a selected color.

14. A printing apparatus for producing a print set including a plurality of copy sheets and at least one insert sheet inserted therein in a predetermined sequence, comprising:

a processing section for transferring a developed image onto a copy sheet;

a finishing section for receiving and arranging plural sheets in a predetermined manner;

at least one sheet feeding tray for selectively delivering copy sheets and insert sheets stored therein into a sheet transport system, said sheet transport system including a main supply transport path coupled between said sheet feeding tray and the processing section for delivering copy sheets thereto;

a bypass transport loop coupled between said main supply transport path and the finishing section for delivering insert sheets thereto;

a movable gate situated adjacent said bypass transport loop for selectively directing sheets along a predetermined path of travel, said movable gate being selectively positionable between a first position for directing the sheets through the main supply transport path and a second position for directing the sheets to the bypass transport loop; and means for providing a control signal to said movable gate such that sheets can be selectively dispensed from said sheet feeding tray to either said main supply transport path or said bypass transport loop at various selected times during generation of a print set.

15. The printing apparatus of claim 14, further including a control system for providing that said insert sheets are delivered to said finishing section for insertion into the print set in accordance with a predetermined sequence.

* * * * *